US008430769B2

(12) United States Patent
Kim

(10) Patent No.: US 8,430,769 B2
(45) Date of Patent: Apr. 30, 2013

(54) GOLF TEE AND METHOD

(76) Inventor: Darrell James Kim, Irvine, CA (US)

( * ) Notice: Subject to any disclaimer, the term of this patent is extended or adjusted under 35 U.S.C. 154(b) by 229 days.

(21) Appl. No.: 12/448,740

(22) PCT Filed: May 17, 2007

(86) PCT No.: PCT/US2007/012013

§ 371 (c)(1),
(2), (4) Date: Dec. 7, 2009

(87) PCT Pub. No.: WO2008/088366

PCT Pub. Date: Jul. 24, 2008

(65) Prior Publication Data

US 2010/0093469 A1 Apr. 15, 2010

Related U.S. Application Data

(60) Provisional application No. 60/879,875, filed on Jan. 11, 2007.

(51) Int. Cl.
*A63B 57/00* (2006.01)

(52) U.S. Cl.
USPC ..... 473/387; 473/401

(58) Field of Classification Search ..... 473/387–403
See application file for complete search history.

(56) References Cited

U.S. PATENT DOCUMENTS 1,562,216 A 11/1925 Flaherty
1,599,207 A * 9/1926 Capen, Jr. ..... 473/401
1,644,979 A * 10/1927 Clausing ..... 473/402
1,645,001 A * 10/1927 Hodges ..... 473/399
2,011,203 A * 8/1935 Seiki ..... 473/396
2,693,358 A * 11/1954 Dawson, Jr. ..... 473/398
3,559,998 A * 2/1971 Kelly ..... 473/396
4,516,773 A * 5/1985 Martin ..... 473/391
5,242,170 A * 9/1993 Ward ..... 473/396
5,571,054 A * 11/1996 Chantal ..... 473/387
6,224,500 B1 * 5/2001 Mizohata ..... 473/396
6,508,727 B1 1/2003 Su
7,090,594 B2 * 8/2006 Kawashima et al. ..... 473/396
2005/0148410 A1 7/2005 DeLisle et al.

OTHER PUBLICATIONS

PCT/US2007/12013, Search Report Report, Sep. 7, 2008, Darrell J. Kim.

PCT/US2007/12013, Report on Patentability, Jul. 14, 2009, Darrell J. Kim.

* cited by examiner

*Primary Examiner* — Steven Wong
(74) *Attorney, Agent, or Firm* — John J. Connors; Connors & Assoc. pc

(57) ABSTRACT

A golf tee comprises substantially conically ball support component with a substantially annular edge substantially surrounding a central recess. The recess is sufficiently deep so that an annular surface area of the ball touches the edge along a circular contact zone when the ball is teed up. A shaft member extends from an apex of the ball support component and comprises a material that breaks or bends as a club head moves through a teed up golf ball to provide a resistance to such movement approaching zero.

4 Claims, 6 Drawing Sheets

ED1
1A
P
14
19
18
E2

10
12
M
LP
E1
CL
1A
E2

12
M
LP
E1
5
16
5

ED1
14
19
4
18
4
20

14
d1
d2
M
16
16a
21
ED1
d3

ED1
16
d1
h3
h2
h1
16a
19
21
l1
w2
l3
CL
10
l2
12
E1
x
y
CL
P
R
J
E3
16
19
16a
12
21
10

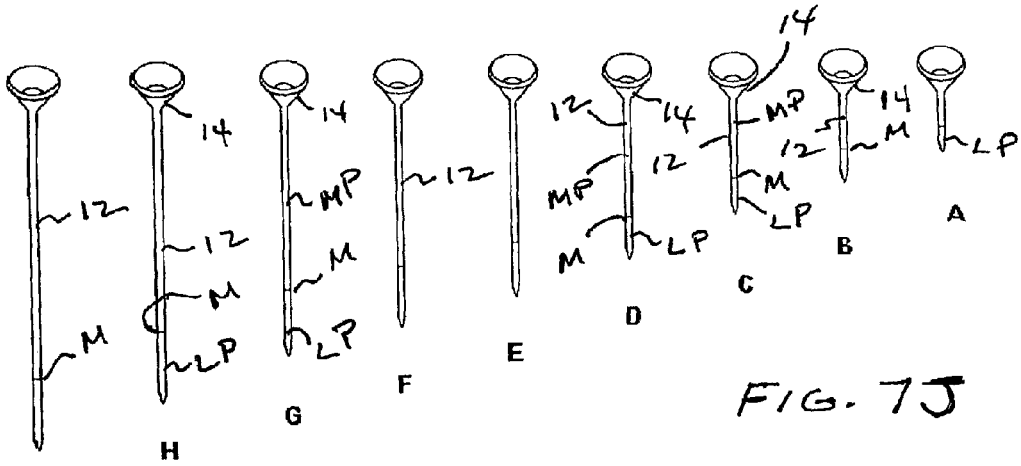
FIG. 6
FIG. 7J
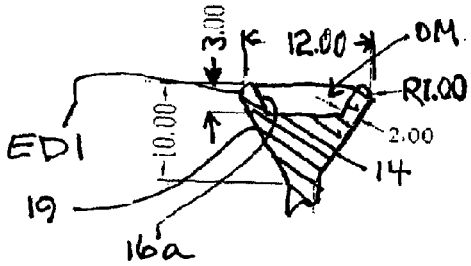
10a
10a
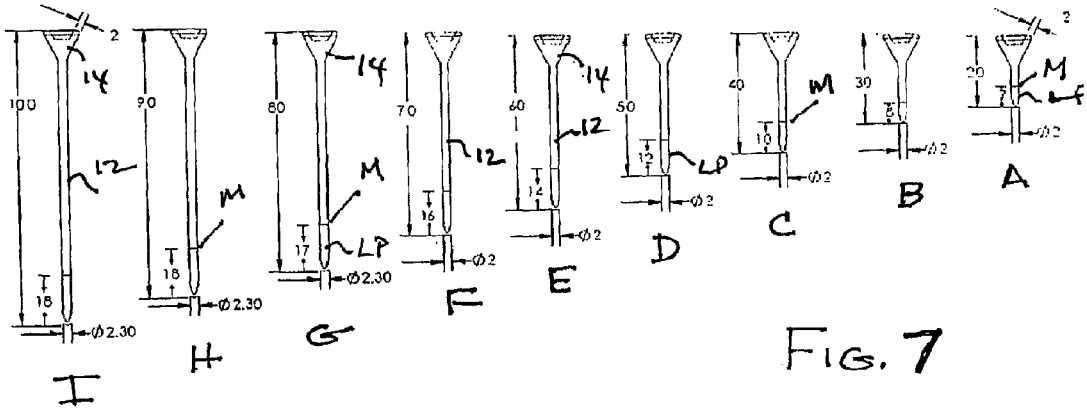
FIG. 7

GOLF TEE AND METHOD

RELATED PATENT APPLICATION & INCORPORATION BY REFERENCE

This is a PCT application which claims the benefit under 35 USC 119(e) of U.S. Provisional Patent Application No. 60/879,875, entitled "Golf Tee," filed Jan. 11, 2007. This related application is incorporated herein by reference and made a part of this application. If any conflict arises between the disclosure of the invention in this PCT application and that in the related provisional application, the disclosure in this PCT application shall govern. Moreover, any and all U.S. patents, U.S. patent applications, and other documents, hard copy or electronic, cited or referred to in this application are incorporated herein by reference and made a part of this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

The words "conical" and "conically" shall mean shaped somewhat like a cone.

BACKGROUND

Golf tees made of wood, plastics, or other substances are used in playing golf to elevate a golf ball above ground level from about ⅛ to about 3 inches. In general, conventional golf tees are rigid and configured to resist movement of the club head through the ball. Because of the high resistance presented by a conventional tee to club head movement, a significant amount of swing energy is used to break or dislodge the tee from the ground. This could result is premature release of the ball from the tee, especially with women and young golfers, who during a golf swing typically generate club head speeds of less than about 70 miles per hour at impact. Moreover, if a golfer miss-hits the ball at the toe or heel of the clubface, any fade or hook will increase due to the high resistance of the conventional tee.

SUMMARY

My golf tee has one or more of the features depicted in the embodiments discussed in the section entitled "DETAILED DESCRIPTION OF SOME ILLUSTRATIVE EMBODIMENTS." The claims that follow define my golf tee and method of use in terms that distinguish it from the prior art and point out its non-obviousness characteristics; however, without limiting the scope of my invention as expressed by these claims, in general terms, some, but not necessarily all, of the features of my golf tee and its method of use are:

One, a ball support component is used having an apex and a base opposite the apex. The base includes therein a recess formed by an internal sidewall terminating at an outer edge that follows a substantially circular path.

Two, the edge has a predetermined configuration and predetermined dimensions to configure it into a support surface with a minimal area that contacts a teed up golf ball.

Three, the sidewall has a predetermined height and angular orientation where a teed up golf ball rests on the edge with a spherical segment of the ball projecting into the recess but offset from the sidewall.

Four, the shaft member either breaks or bends or is dislodged as a club head strikes the teed up golf ball during a golf swing.

These features are not listed in any rank order nor is this list intended to be exhaustive.

My method comprises using an embodiment of my tee having a marker on the shaft member that identifies the optimum depth that a lower shaft portion is to be pushed into the ground. The length of the tee and the marker position along the shaft member corresponds to the type of tee shot being executed.

DESCRIPTION OF THE DRAWING

Some embodiments of my golf tee and method of use will now be discussed in detail in connection with the accompanying drawing, which is for illustrative purposes only. This drawing includes the following figures (FIGS.), with like numerals indicating like parts:

FIGS. 6A through 6I are a series of perspective views of the embodiment of my golf tee shown in FIGS. 8 and 9 having different sizes.

FIGS. 7A through 7I are a series of side views of the tees shown on FIGS. 6A through 6I with some specific dimensions identified.

FIG. 7J is a fragmentary cross-sectional view of the ball support component of the tee shown in FIGS. 8 and 9 with some specific dimensions identified.

PRIOR ART

Figure 12:
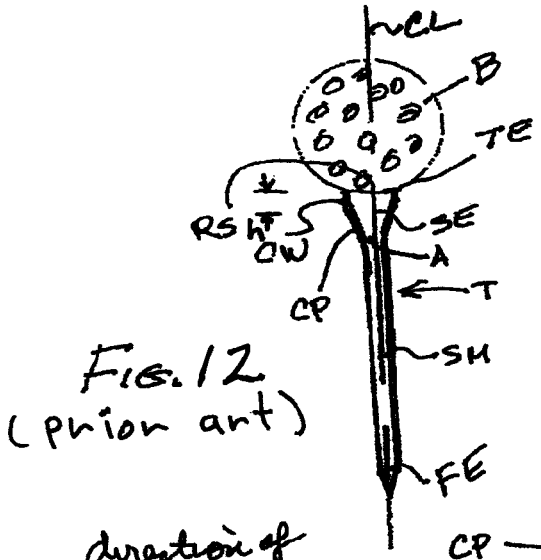
FIG. 12 (prior art)
FIG. 12 is a side elevational view of a conventional prior art golf tee supporting a teed-up golf ball.
Figure 13:
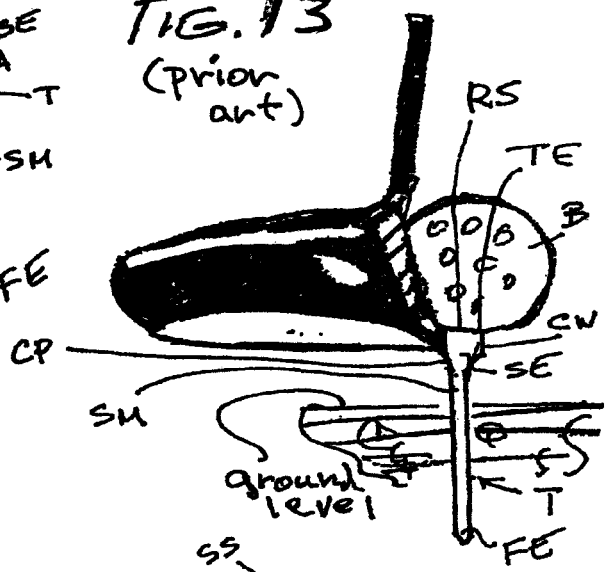
FIG. 13 (prior art)
FIG. 13 is side view of a golf club head striking a golf ball teed up on the conventional prior art golf tee shown in FIG. 12.

As depicted in FIGS. 12 and 13, a golf tee T commonly employed comprises an integral, unitary, single-piece wood, plastic, or granular-press molded structure that is rigid and inflexible. It comprises a support element SE for a golf ball B and a shaft member SM integral with the support element. The support element SE typically has an upper cylindrical wall CW forming a land. The height h (FIG. 12) of the cylindrical wall CW is typically in excess of 2 millimeters. A conically shaped portion CP extends from a lower end of the cylindrical wall CW, tapering inward towards and merging with the shaft member SM. The shaft member SM extends along a longitudinal centerline CL from an apex A of the conical portion CP. An outer terminal edge TE forms a perimeter of a recessed spherical surface segment RS in which rests a spherical segment of a teed up golf ball B.

A teed up ball's spherical segment contacts substantial portions of the entire recessed spherical surface segment RS. Such contact of these spherical surfaces and the elevated cylindrical wall CW impede or resist the movement of a club head during a golf swing. As shown in FIG. 13, after pushing a pointed or free end FE of the shaft member SM into the ground and resting the ball B on the recessed spherical segment RS, the golfer strikes the ball with a golf club. The friction created between the contacting spherical surfaces and the cylindrical wall CW increases the tee's resistance to movement of a dub head during a golf swing. The average resistance for typical wood tees having a diameter greater than about 4-5 millimeters has been measured at from about 30 to 45 about pounds.

DETAILED DESCRIPTION OF SOME ILLUSTRATIVE EMBODIMENTS

General

Figure 8:
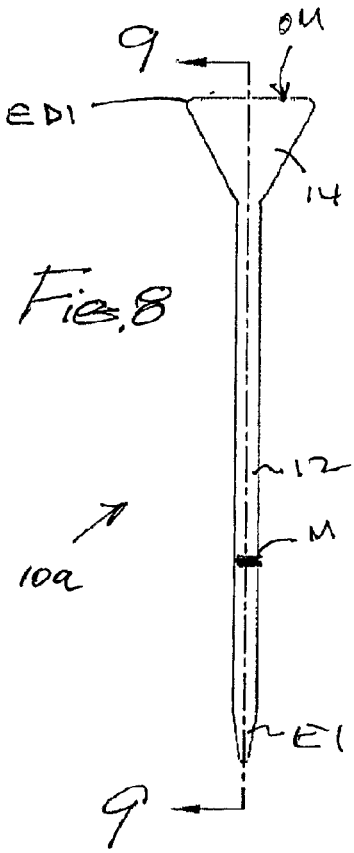
FIG. 8 is a side elevational view of another embodiment of my golf tee.
Figure 9:
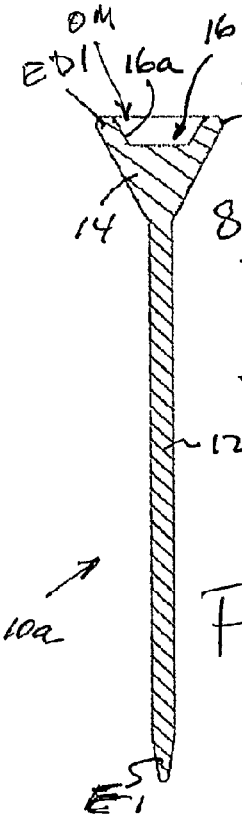
FIG. 9 is a cross-sectional view taken along line 9-9 of FIG. 8.
Figure 9A:
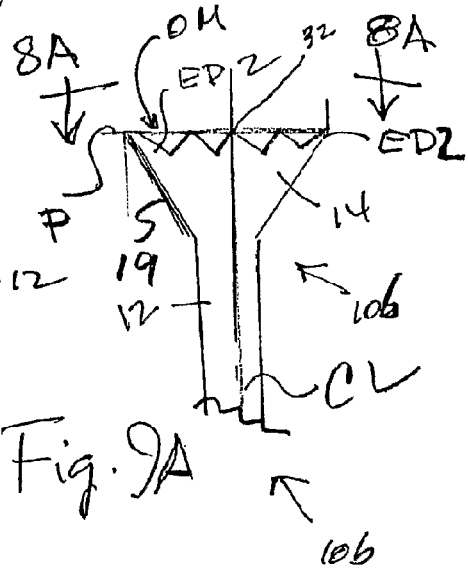
FIG. 9A is a fragmentary side elevational view of the alternate embodiment of my tee shown in FIG. 8A.
Figure 8A:
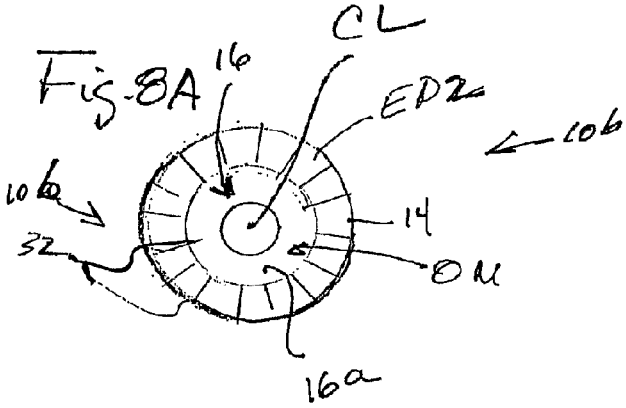
FIG. 8A is an end view of yet another embodiment of my golf tee taken along line 8A-8A of FIG. 9A.

There are illustrated three embodiments of my golf tee: a two-piece tee generally designated by the numeral 10 in FIGS. 1 through 5 a single-piece, unitary tee generally designated by the numeral 10*a* in FIGS. 8 and 9, and another single-piece, unitary tee generally designated by the numeral 10*b* in FIGS. 8A and 9A. Each of these golf tees 10, 10*a*, and 10*b* includes a shaft member 12 and a substantially conical ball support component 14 connected to the shaft member. The ball support component 14 includes a recess 16 formed by an internal sidewall 16*a* terminating at an edge forming an open mouth OM that receives a spherical portion of the teed up ball B. The edge has a predetermined configuration and predetermined dimensions to configure it into a contact support surface with a minimal area. For example, the tees 10 and 10*a* each have an outer edge ED1 that provides a continuous contact support surface, and the tee 10*b* has an outer edge ED2 (FIG. 9A) that provides an intermittent contact support surface.

Figures 1, 2, 3, 4, 5:
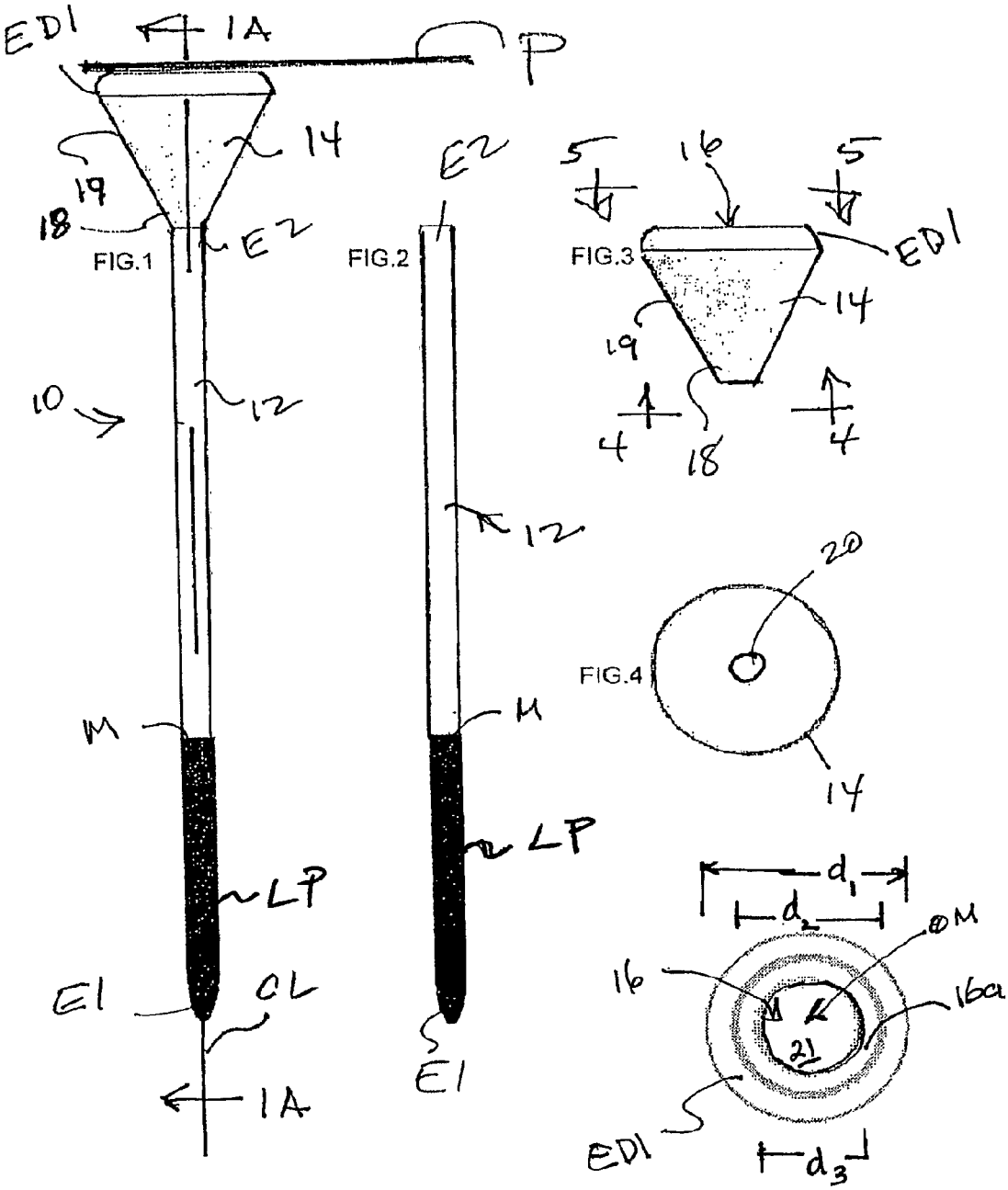
FIG. 1 is a side elevational view of one embodiment of my golf tee.
FIG. 2 is a side elevational view of the shaft member of my tee that is shown on FIG. 1.
FIG. 3 is a side elevational view of the ball support component of my tee that is shown on FIG. 1.
FIG. 4 is an end view taken along line 4-4 of FIG. 3.
FIG. 5 is an end view taken along line 5-5 of FIG. 3.
Figures 1A, 1B:
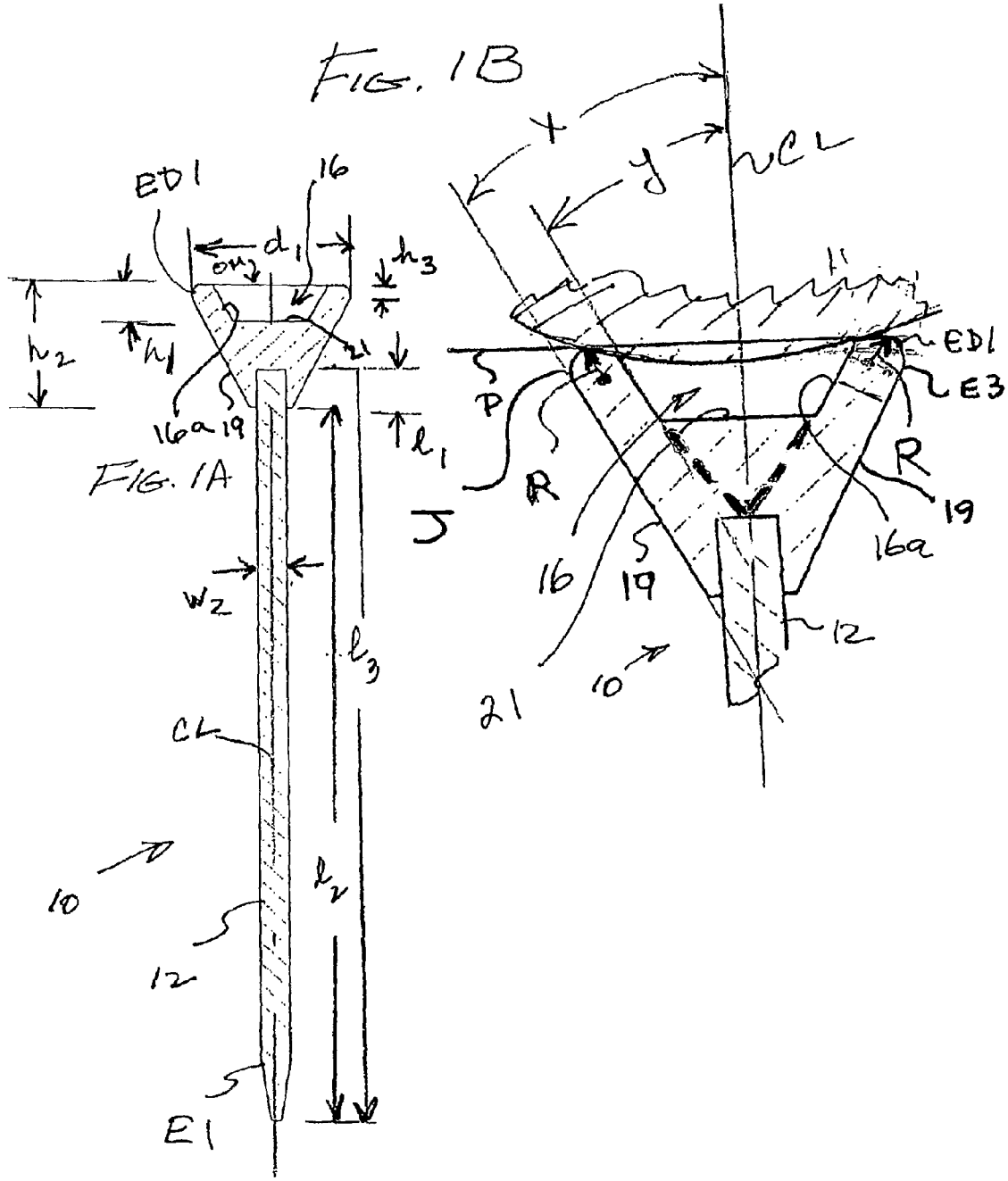
FIG. 1A is a cross-sectional view taken along line 1A-1A of FIG. 1.
FIG. 1B is an enlarged, fragmentary cross-sectional view illustrating the manner in which a golf ball sits on my tee as depicted in FIG. 1C.

An upper terminal end E3 (FIG. 1B) of an external sidewall 19 of the ball support component 14 merges with the edge ED1 or ED2, as the case may be. The junction J where the upper terminal end E3 and the edge ED1 or In the case of the edge ED2 as depicted in FIG. 9A, this edge intersects at its tips 32 a plane P (FIGS. 1 and 9A) that is substantially flush with, and is substantially at a right the centerline CL and lies over and contacts the open mouth OM. or In the case of the edge ED1 as depicted in FIG. 1B, this edge may be displayed slightly below the plane P a distance equal to the height $h_3$ (FIG. 1A) of the rounded edge ED1. The angular orientation angle x (FIG. 1B) of the sidewall 16*a* with respect to the centerline CL may be substantially from 15 to 40 degrees. This structural configuration avoids formation of a cylindrical wall CW or land that interferes with the movement of a club head during a golf swing.

Each tee has a predetermined size, material properties, and configuration to provide a resistance to movement of a club head during a golf swing that approaches zero. Depending on the material used to form a tee, the shaft member 12 either breaks or bends as a dub head strikes the teed up golf ball during a golf swing. For example, tooth pick type wooden material tends to snap and break; bamboo bends. Because of this difference, tees with shaft members that break are not reusable for the most part. This may be unacceptable to some golfers, but of no consequence to others. On the other hand, tees that bend and are resilient may be used over and over and are more acceptable. In order to satisfy a broader consumer market, one embodiment of my tee employs a shaft member 12 that breaks and another embodiment employ a shaft member 12 that bends. These different embodiments are not, however, equivalent. In the one embodiment of my tee, the shaft member breaks 90 percent of the time a golf ball teed up thereon is struck when executing a tee shot with a club head velocity of 70 miles per hour at impact. In the other embodiment, the shaft member does not break but bends 90 percent of the time a golf ball teed up thereon is struck when executing a tee shot with a club head velocity of 70 miles per hour at impact.

The dimensions of the tees 10, 10*a* and 10*b* are important in minimizing resistance to club head movement.

Figure 10:
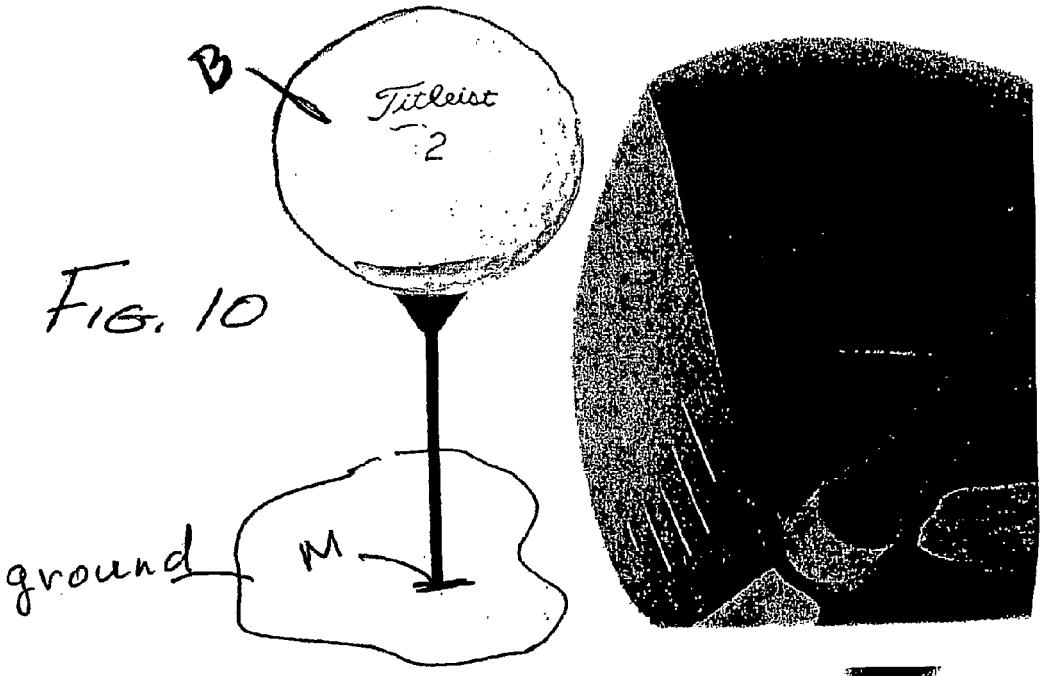
FIG. 10 is a golfer's view of a ball teed up according to my method where a long tee is used for a wood shot.
Figure 11:
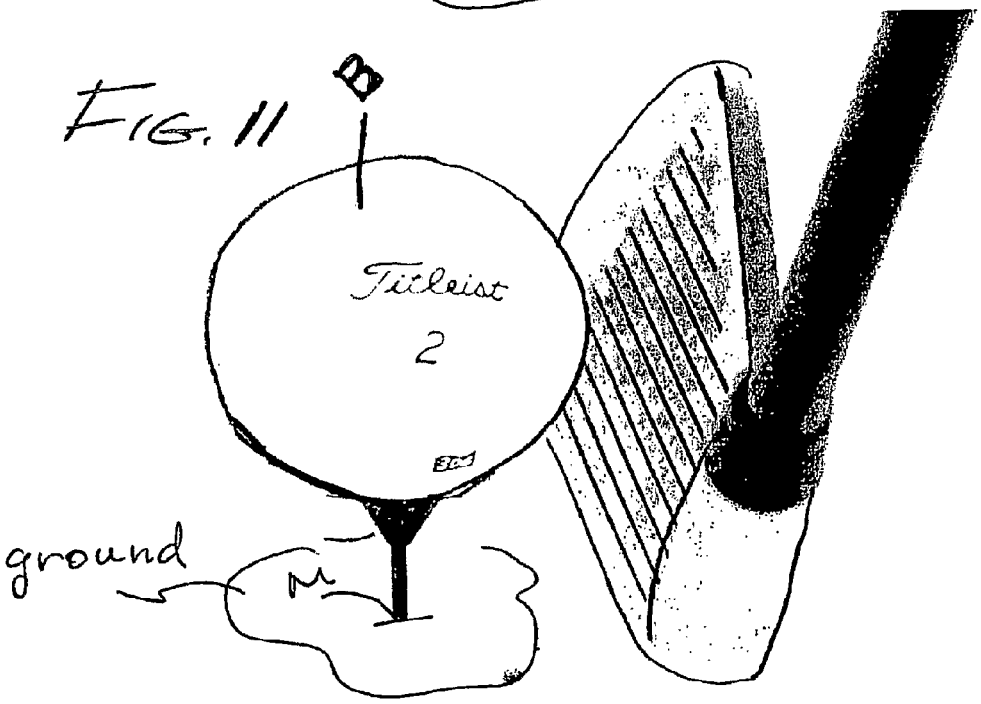
FIG. 11 is a golfer's view of a ball teed up according to my method where a short tee is used for an iron shot.

The shaft member 12 is substantially solid and extends from an apex 18 of the ball support component 14 along the tee's longitudinal centerline CL. The width $w_2$ (FIG. 1A) of the shaft member 12 is less than approximately 2.75 millimeters and its length $l_2$ may be substantially from 20 to 100 millimeters. In general the width $w_2$ is about half that of a conventional wooden tee, or substantially from 2 to 2.5. A lower portion of the shaft member 12 may include a marker M that is substantially from 5 to 40 millimeters inward of an outer point tip or free end E1 of the shaft member 12. In accordance with the method of using my tee, this marker M identifies the depth that the lower portion is to be pushed into the ground when teeing up the golf ball B. This maker M may take several forms such as a line or a painted lower section using different colors to distinguish tees of different sizes. The marker M is at an optimum position for the type of shot for which a tee is being used. Tees with different length are used for different shots and the marker M is at different positions corresponding to the type of shot being executed by the golfer. For example as illustrated in FIG. 10 the ball B teed up using a long tee for a wood shot, perhaps having a total tee length of 100 millimeters. In FIG. 11 the ball B is teed up using short tee for an iron shot, perhaps having a total tee length of 30 millimeters.

Figure 1C:
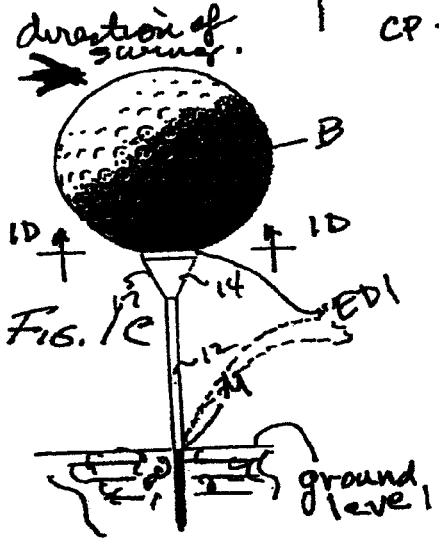
FIG. 1C is a side elevational view of a golf ball seated on my tee that is shown on FIG. 1.
Figure 1D:
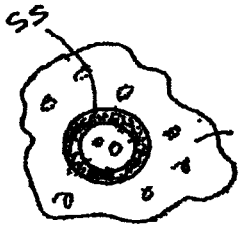
FIG. 1D is a cross-sectional view taken along line 1D-1D of FIG. 1C.

The edges ED1 and ED2 each have a contact support surface that is less than approximately 45 square millimeters. As illustrated in FIGS. 5 and 8A, these edges ED1 and ED2 each follow a substantially circular path. As depicted in FIG. 1D as gray area, only an annular surface segment SS of the teed up golf ball B contacts edges ED1 or ED2, as the case may be.

The edge ED1 may be rounded and may have a radius R of curvature (FIG. 1B) substantially from 0.75 to 1.25 millimeters This rounded edge is substantially semicircular in cross-section and may have an outer diameter $d_1$ substantially from 8.5 to 11 millimeters and an inner diameter $d_2$ substantially from 4 to 7 millimeters and a height $h_3$ (FIG. 1A) substantially from 1 to 2 millimeters. The width $w_1$ of each edge ED1 and ED2 has a maximum, being less than 3 millimeters.

As best illustrated in FIG. 1B, the sidewall 16*a* has a predetermined height $h_2$ and angular orientation where the teed up golf ball rests on the edge ED1 with a spherical segment of the ball projecting into the recess but offset from the sidewall. The angular orientation angle y (FIG. 1B) of the sidewall 16*a* may be substantially from 10 to 40 degrees. Consequently, as shown in FIG. 1C, for example, no more than 1 percent of the spherical surface of the ball is estimated to project into the recess 16. As shown in FIG. 1B, for example, the height of the sidewall 16*a* may be substantially from 2 to 10 millimeters.

FIGS. 1 through 5

In the golf tee 10 the shaft member 12 is one piece and the ball support component 14 is a separate piece that is connected to the shaft member. The ball support component 14 may be substantially conical, and the shaft member 12 may be substantially cylindrical, resilient and flexible, for example, be made of bamboo, and the ball support component 14 may be made of the wood other than bamboo. As illustrated in FIG. 1C, the bamboo shaft member 12 flexes and moves into the position shown in dotted lines as the club head moves through the ball B.

As best shown in FIG. 1A, an opposite end E2 of the shaft member 12 is attached to the apex 18 of the ball support component 14. The end E2 may be inserted into a cavity 20 (FIG. 4) in the apex 18 of the ball support component 14 at a position opposed to the edge ED1 and along the centerline CL. A length $l_1$, substantially from 1 to 4 millimeters of the end E2 is inserted into the cavity 20 and a bonding agent such as glue may be used to hold the two pieces together.

As shown in FIGS. 1B and 1C, the recess 16 may have a central truncated conically configured shape formed by the sidewall 16*a*, which tapers inwardly towards the centerline CL. The other end of the tapering sidewall 16*a* terminates in a substantially flat, circular, planar floor 21 having a diameter $d_3$ that may be substantially from 0 to 5 millimeters. Alternately, as depicted in dotted lines in FIG. 1B, the sidewall 16*a* may taper to a point with no floor.

FIGS. 6A through 7J

As illustrated in FIGS. 6A through 61 and FIGS. 7A through 71 the tees 10 and 10*a* may have shaft members 12 of different sizes, with both length and diameters varying. Some of the specific dimensions of the different sized tees are depicted in FIGS. 7A through 7J.

FIGS. 8 and 9

The tee 10*a* is similar to the tee 10, except it is a single piece, unitary structure. It may be machined on a lath from a wood block, or injection molded from plastic, or press formed in a mold from small particles that are bonded together. Biodegrade materials may be used.

FIGS. 8A through 9A

Figure 8B:
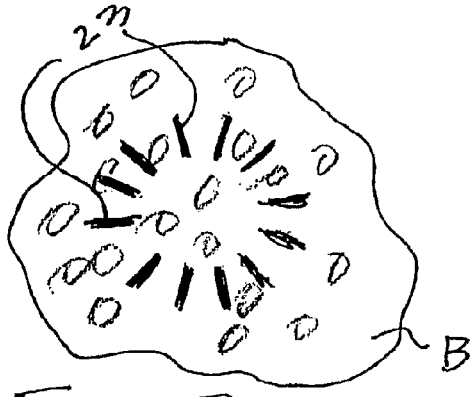
FIG. 8B is a fragmentary plan view of the surface of a golf ball showing as radial lines the contacts on a golf balled teed up on the embodiment shown in FIGS. 8A and 9A.

The tee 10*b* is similar to the tee 10*a* being a single piece, unitary structure, except it has the serrated edge ED2 that further diminishes the contact area between the tee's edge forming the open mouth OM and intermittent surface portions arrangement in a circular path as depicted in FIG. of the teed up ball B. Only the tips 32 of the serrations make contact with a teed up ball B. This is illustrated in FIG. 8B by radial lines 23 that identify the contacts areas between the tips 32 and the surface of a golf balled teed up on the embodiment shown in FIGS. 8A and 9A. These tips 32 are radially oriented outward substantially at a right angle to the centerline CL and are, all in the plane P and all lie along a circular path corresponding to the generally circular arrangement of the tips 32.

Method of Use

A novel method of teeing up a golf ball is provided using my golf tees. Because these tees 10, 10*a*, and 10*b* each have a predetermined size, material properties, and configuration to provide a resistance to movement of a club head during a golf swing that approaches zero, tee shots are improved. As illustrated in FIG. 1C, the golfer pushes the free end E2 of the shaft member into the ground a predetermined distance when teeing up the golf ball as determined by the marker M identifying the optimum predetermined distance that this lower portion is to be pushed into the ground. This marker M is at different positions along the shaft member 12 depending on the length of the shaft member, with the marker M being further from the end E2 for longer shaft members. The golfer continues pushing the tee 10 or 10*a*, as the case may be, into the ground until the marker M is substantially even with ground level. Different sized tees are used depending of the type of shot being executed as discussed above. Because the width $w_2$ of the shaft member 12 is so narrow and the end E1 pointed, it easily to insert the tee into the ground.

The deeper that a tee is pushed into the ground, the greater its resistance. In my method, as best illustrated in FIG. 6, a major portion MP of the length of the shaft member 12 is between the marker M and the ball support component 14. For distance shots such as drives as depicted in FIG. 10, a long tee, for example the tee shown in FIG. 6I, may be used. This tee shown in FIG. 6I has the marker M positioned so that less than about 25 percent of the shaft member's length comprises the lower portion. This percentage increases as the length of the shaft member 12 decreases, approaching 50 percent for the tee shown in FIG. 6A. A short tee shot as depicted in FIG. 11, may use a tee with a relatively short shaft length, for example the tee shown in FIG. 6C, may be used.

SCOPE OF THE INVENTION

The above presents a description of the best mode contemplated of my golf tee, and of the manner and process of making and using it, in such full, clear, concise, and exact terms as to enable any person skilled in the art to which it pertains to make and use my golf tee. My golf tee is, however, susceptible to modifications and alternate constructions from the illustrative embodiments discussed above which are fully equivalent. Consequently, it is not the intention to limit my golf tee to the particular embodiments disclosed. On the contrary, my intention is to cover all modifications and alternate constructions coming within the spirit and scope of my invention as generally expressed by the following claims, which particularly point out and distinctly claim the subject matter of my invention:

The invention claimed is:

1. A golf tee comprising a substantially conically configured ball support component having an apex, a base opposite the apex, and a longitudinal center line passing through the apex at a substantially right angle to the base, said base terminating at a substantially circular edge having a predetermined configuration and predetermined dimensions to configure the edge into a support surface with a minimal area that is less than approximately than 45 square millimeters contacting a teed up golf ball, said ball support component including an inwardly tapering external sidewall that at one end terminates at the circular edge in a manner that substantially avoids formation of a land that interferes with the movement of a club head through a golf ball teed up on said tee, said edge encompassing a central truncated conically configured recess with a depth substantially no greater than 3 millimeters and formed by an inwardly tapering internal sidewall having a sufficient height that a teed up golf ball rests on the edge with a spherical segment of the ball projecting into the recess but offset from the internal sidewall, the recess being sufficiently deep so that less than 1 percent of the surface area of a golf ball makes contact with the edge when the ball is teed up, and said edge being rounded and having a width that is substantially no greater than 3 millimeters and a radius of curvature substantially from 0.75 to 1.25 millimeters, said rounded circular edge having an outer diameter substantially from 8.5 to 11 millimeters and an inner diameter substantially from 4 to 7 millimeters and a height substantially from 1 to 2 millimeters, said base having an outside diameter substantially from 8.5 to 11 millimeters, with the distance from the edge to the apex being substantially from 8 to 12 millimeters, and an elongated, solid shaft member extending from the apex along the longitudinal center line and comprising a resilient material, said shaft member having a pointed free end and an opposed end connected to the apex, a length substantially from 20 to 100 millimeters, a width less than 2.75 millimeters, and a substantially uniform cylindrical cross-sectional configuration along said length, said shaft member thereby breaking or bending as a club head moves through a teed up golf ball to provide a resistance to such movement approaching zero, said shaft member breaking 90 percent of the time a golf ball teed up thereon is struck while executing a tee shot with a club head velocity of 70 miles per hour at impact.

2. The golf tee of claim 1 where the shaft member and the ball support component are integral and form a unitary structure.

3. The golf tee of claim 1 where the shaft member and the ball support component are separate pieces.

4. The golf tee of claim 1 where the ball support and the shaft member are separated components and the ball support component consists essentially of wood other than bamboo and the shaft member consists essentially of bamboo and has an end opposed to the pointed free end, said opposed end being inserted into a cavity at the apex.

* * * * *